US009504104B2

(12) United States Patent
Moon et al.

(10) Patent No.: US 9,504,104 B2
(45) Date of Patent: Nov. 22, 2016

(54) POWER SUPPLY APPARATUS AND DRIVING METHOD THEREOF

(71) Applicant: FAIRCHILD KOREA SEMICONDUCTOR LTD., Bucheon-si (KR)

(72) Inventors: SangCheol Moon, Daejeon (KR); Gwanbon Koo, Bucheon-si (KR)

(73) Assignee: Fairchild Korea Semiconductor LTD. (KR)

( * ) Notice: Subject to any disclaimer, the term of this patent is extended or adjusted under 35 U.S.C. 154(b) by 0 days.

(21) Appl. No.: 14/293,155

(22) Filed: Jun. 2, 2014

(65) Prior Publication Data

US 2014/0354167 A1 Dec. 4, 2014

(30) Foreign Application Priority Data

Jun. 4, 2013 (KR) ..... 10-2013-0064273

(51) Int. Cl.
*H05B 37/02* (2006.01)
*H05B 33/08* (2006.01)

(52) U.S. Cl.
CPC ..... *H05B 33/0815* (2013.01); *H05B 33/0854* (2013.01)

(58) Field of Classification Search
CPC ..... H05B 33/0815; H05B 33/0845; H05B 33/0851
USPC ..... 315/206, 219, 224, 274, 276, 291, 297, 315/307, 308
See application file for complete search history.

(56) References Cited

U.S. PATENT DOCUMENTS

| | | | | |
|---|---|---|---|---|
| 7,759,881 | B1 * | 7/2010 | Melanson | 315/307 |
| 7,872,427 | B2 | 1/2011 | Scianna | |
| 8,139,378 | B2 | 3/2012 | Zou | |
| 8,203,276 | B2 | 6/2012 | Shackle et al. | |
| 8,222,832 | B2 | 7/2012 | Zheng et al. | |
| 9,167,642 | B2 * | 10/2015 | Yoshimoto | H05B 33/0815 |
| 2008/0136350 | A1 * | 6/2008 | Tripathi | H05B 33/0803 315/294 |
| 2011/0175543 | A1 * | 7/2011 | Sun et al. | 315/291 |
| 2011/0194311 | A1 * | 8/2011 | Gaknoki et al. | 363/21.12 |
| 2012/0262082 | A1 * | 10/2012 | Esaki | H05B 33/0848 315/224 |
| 2013/0033197 | A1 * | 2/2013 | Hwang | H05B 33/0815 315/307 |
| 2013/0154487 | A1 * | 6/2013 | Kuang | H05B 33/0851 315/171 |

* cited by examiner

*Primary Examiner* — Tung X Le
(74) *Attorney, Agent, or Firm* — Grossman Tucker Perreault & Pfleger PLLC

(57) ABSTRACT

A power supply apparatus and a driving method thereof are disclosed

The power supply apparatus includes: a dimmer controlling externally input power; a converter including a switch, and converting an output of the dimmer according to a duty of the switch and supplying a first current to a load; a dimming feedback unit receiving a first voltage corresponding to the first current, and having a finite gain in a DC state; and a controller controlling the duty of the switch according to an output of the dimming feedback unit. A duty of the switch is controlled according to an output of such a dimming feedback unit so that a dimming operation is performed.

23 Claims, 11 Drawing Sheets

POWER SUPPLY APPARATUS AND DRIVING METHOD THEREOF

CROSS-REFERENCE TO RELATED APPLICATION

This application claims priority to and the benefit of Korean Patent Application No. 10-2013-0064273 filed in the Korean Intellectual Property Office on Jun. 4, 2013, the entire contents of which are incorporated herein by reference.

BACKGROUND OF THE INVENTION (a) Field of the Invention

The present invention relates to a power supply apparatus and a driving method thereof.

(b) Description of the Related Art

A power supply apparatus is an apparatus that converts a predetermined input voltage to a desired output voltage. Such a power supply apparatus is installed in various electronic device products to convert an external AC voltage to various voltages required for driving of the electronic device products.

As a means for replacing existing lighting devices such as a fluorescent lamp and an incandescent lamp, a light emitting LED has been spotlighted. The light emitting LED has a semipermanent characteristic and power consumption of the LED is low so that the light emitting LED can be variously used. As an apparatus for supplying a predetermine current to such a light emitting LED, a power supply apparatus is mounted. The power supply apparatus receives external AC power and provides a predetermined current for driving the LED.

Meanwhile, a power supply apparatus for the light emitting LED has a dimmer and thus a user can control brightness of the LED. As an example of the dimmer, a triac dimmer may be used, and the triac dimmer controls an angle size of a waveform of an externally input AC voltage by user's control. In addition, the angle size of the voltage waveforms output from the triac dimmer is sensed and a reference voltage (or, current) is changed according to the sensed angle size such that an output current is controlled. Here, the reference voltage (or, current) is a voltage used to control a duty of a main switch, and the reference voltage is compared with a voltage that corresponds to the output current of the power supply apparatus. That is, the reference voltage is changed by user's control in the conventional power supply apparatus for an LED, and the output current is changed according to the change of the reference voltage such that brightness of the LED is controlled.

Such a conventional LED power supply apparatus additionally needs a sense circuit to sense an angle size with respect to an output waveform of a triac dimmer, and accordingly a circuit for converting a reference voltage (or, current) according to the angle sensed by the sense circuit is additionally required.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a power supply apparatus that can control brightness of an LED through a simple structure, and a method for driving the same.

According to an exemplary embodiment of the present invention, a power supply apparatus is provided. The power supply apparatus includes: a dimmer controlling externally input power; a converter including a switch, and converting an output of the dimmer according to a duty of the switch and supplying a first current to a load; a dimming feedback unit receiving a first voltage corresponding to the first current, and having a finite DC gain; and a controller controlling the duty of the switch according to an output of the dimming feedback unit.

When an angle of a output waveform of the dimmer is decreased, the first current is decreased, and when the angle of the output waveform of the dimmer is increased, the first current is increased. The dimming feedback unit may include: an amplifier having the first voltage input to a first input terminal thereof and a predetermined reference voltage input to a second input terminal thereof; and a first resistor connected between the first input terminal and an output terminal of the amplifier. The dimming feedback unit further may further include a first capacitor connected between the first input terminal and the output terminal of the amplifier. The dimming feedback unit further may further include a second resistor and a second capacitor connected in series between the first input terminal and the output terminal of the amplifier.

The dimming feedback unit may include: an amplifier having the first voltage input to a first input terminal thereof and a predetermined reference voltage input to a second input terminal; and a first resistor connected between an output terminal of the amplifier and a ground. The dimming feedback unit may further include a first capacitor connected between the output terminal of the amplifier and the ground. The dimming feedback unit may further include a second capacitor and a second resistor connected in series between the output terminal of the amplifier and the ground. The amplifier may be a mutual conductance amplifier.

The predetermined reference voltage may have a fixed value.

The power supply apparatus may further include a rectification unit rectifying an output of the dimmer and supplying the rectified value to the converter.

The load may be LEDs.

The first voltage may be generated using the first current and the first voltage may be supplied to the dimming feedback unit.

The converter further includes a transformer, and the power supply apparatus may further include an output current estimation unit generating the first voltage corresponding to the first current using primary side information of the transformer and providing the first voltage to the dimming feedback unit.

According to another exemplary embodiment of the present invention, a method for driving a power supply apparatus including a switch and converting externally input power through a duty of the switch and supplying a first current to a load is provided. The driving method includes: controlling the input power; rectifying the controlled power; converting the rectified power through the duty of the switch and providing the first current to the load; comparing the first voltage corresponding to the first current with a reference voltage and generating a second voltage; and controlling the duty of the switch corresponding to the second voltage, and a transfer function, which is a ratio of the first voltage and the second voltage may have a finite DC gain.

The first current may be proportional to the controlled power.

The reference voltage may have a fixed value.

The generating the second voltage may include: providing an amplifier of which a first input terminal is supplied with the first voltage and a second input terminal is supplied with the reference voltage; and providing a first resistor connected between the first input terminal and an output terminal of the amplifier, wherein the second voltage is output to the output terminal of the amplifier. The generating the second voltage may further include providing a first resistor connected between the first input terminal and the output terminal of the amplifier. The generating the second voltage may further include providing a second resistor and a second capacitor connected in series between the first input terminal and the output terminal of the amplifier The generating the second voltage may include: providing an amplifier of which a first input terminal is supplied with the first voltage and a second input terminal is supplied with the reference voltage; and providing a first resistor connected between an output terminal of the amplifier and a ground, wherein the second voltage is output to the output terminal of the amplifier. The generating the second voltage may further include providing a first capacitor connected between the output terminal of the amplifier and the ground. The generating the second voltage may further include providing a second resistor and a second capacitor connected in series between the output terminal of the amplifier and the ground.

The amplifier may be a differential amplifier.

The amplifier may be a mutual conductance amplifier.

The load may be LEDs.

According to the exemplary embodiments of the present invention, brightness of an LED can be controlled using a simple structure without a sense circuit that senses a dimming angle and a circuit that changes a reference voltage.

DETAILED DESCRIPTION OF THE EMBODIMENTS

Figure 1:
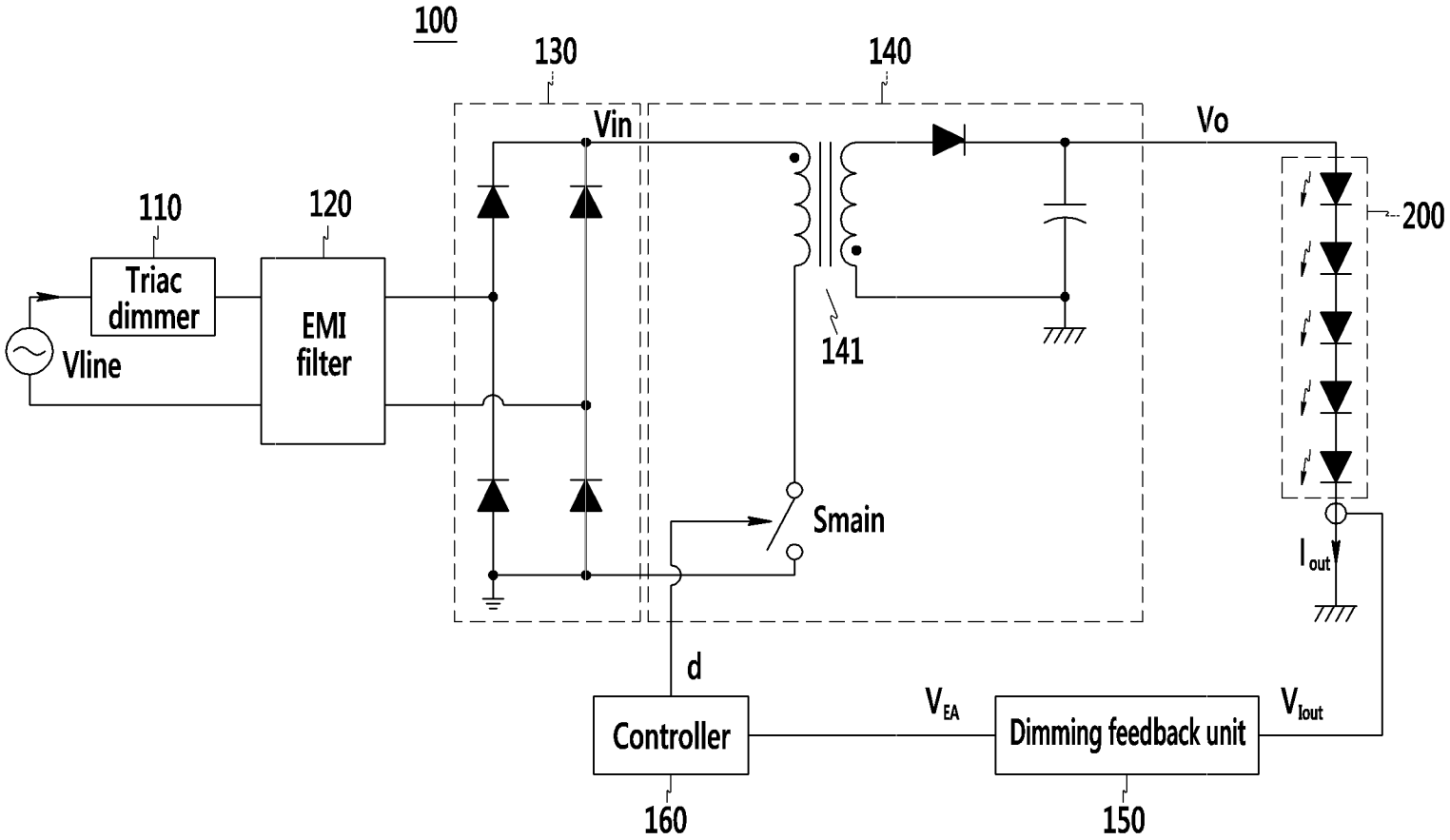
FIG. 1 shows a power supply apparatus according to a first exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

Hereinafter, a power supply apparatus according to an exemplary embodiment of the present invention, and a driving method thereof will be described.

FIG. 1 shows a power supply apparatus according to a first exemplary embodiment of the present invention.

As shown in FIG. 1, a power supply apparatus 100 according to a first exemplary embodiment of the present invention includes a triac dimmer 110, an EMI filter 120, a rectification unit 130, a converter 140, a dimming feedback unit 150, and a controller 160.

The triac dimmer 110 controls an angle size of a waveform of an externally input AC voltage $V_{line}$ according to user's control. The triac dimmer 110 controls the size of a voltage waveform by blocking a current when an angle is higher or lower than a constant phase angle in the input AC voltage $V_{line}$ to control an angle size of the voltage waveform.

The EMI filter 120 eliminates an electromagnetic wave of the externally input AC $V_{line}$, and the rectification unit 130 outputs a rectification voltage $V_{line}$ by performing half-wave of full-wave rectification on an output of the EMI filter 120.

The converter 140 turns on/off a main switch $S_{main}$ according to a duty d output from the controller 160, and outputs an output voltage $V_o$ by converting an input rectification voltage $V_{line}$ and. FIG. 1 illustrates that the converter 140 is a flyback converter, but the present invention is not limited thereto. The converter 140 may be realized as various converters such as a buck-boost converter, a boost converter, a buck converter, a forward converter, and the like.

As described, the output voltage $V_o$ output from the converter 140 is applied to LED strings 200 such that the LED string 200 is driven. In this case, an output current $I_{out}$ to the LED string 200, and brightness of the LED strings 200 is controlled according to the magnitude of the output current $I_{out}$. FIG. 1 illustrates that the LED strings 200 are connected in series, but the LED strings may be connected in parallel or connected in combination of parallel and series.

The dimming feedback unit 150 receives a feedback voltage $V_{Iout}$ corresponding to the output current $I_{out}$, compares the feedback voltage $V_{Iout}$ and a reference voltage $V_{ref}$ and outputs an error voltage $V_{EA}$. A resistor is connected between the LED string 200 and a ground, and the output current $I_{out}$ can be converted to the feedback voltage $V_{Iout}$. Unlike a conventional method, according to the first exemplary embodiment of the present invention, the reference voltage $V_{ref}$ is not fluctuated according to an output of the triac dimmer 110.

The controller 160 receives the error voltage $V_{EA}$ output from the dimming feedback unit 150, and the duty d of the main switch $S_{main}$ is determined according to the error voltage $V_{EA}$. In addition, the controller 160 turns on/off the main switch $S_{main}$ according to the duty d.

Figure 2:
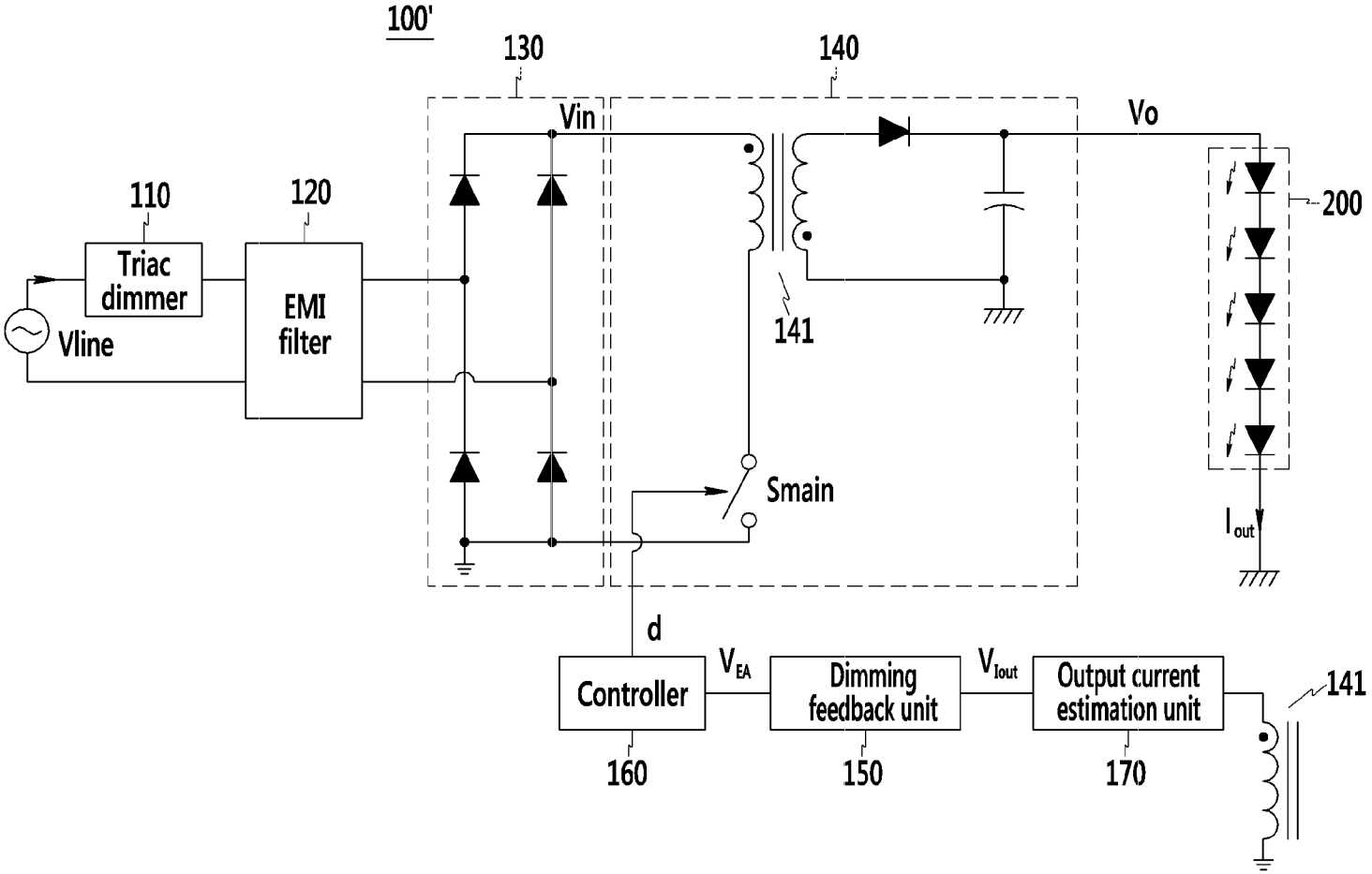
FIG. 2 shows a power supply apparatus 100' according to a second exemplary embodiment of the present invention.

Meanwhile, in FIG. 1, the feedback voltage $V_{Iout}$ input to the dimming feedback unit 150 is generated using the feedback voltage $V_{Iout}$, but as shown in FIG. 2, the feedback voltage $V_{Iout}$ may be used using primary side information of a transformer 141.

FIG. 2 shows a power supply apparatus 100' according to a second exemplary embodiment of the present invention.

As shown in FIG. 2, the power supply apparatus 100' according to the second exemplary embodiment of the present invention is the same as the power supply apparatus 100 of the first exemplary embodiment, excluding that a feedback voltage $V_{Iout}$ is generated using an output current $I_{out}$ estimation unit 170. The output current estimation unit 170 estimates the output current $I_{out}$ using primary side information of a transformer 141, and outputs the feedback voltage $V_{Iout}$ through the estimated value. As described, a feedback control method through estimation of an output current $I_{out}$ using primary side information of the transformer 141 is also referred to as a primary side regulation method. Such a primary side regulation method is known to a person skilled in the art, and therefore no further description will be provided.

In addition, other constituent elements, excluding the output current estimation unit 170 are the same as those shown in FIG. 1, and therefore no further description will be provided.

A dimming feedback unit 150 according to the second exemplary embodiment of the present invention has a constant gain in a DC state. That is, when a ratio of an output error voltage $V_{EA}$ with respect to an input feedback voltage $V_{out}$ is a transfer function A(s) of the dimming feedback unit 150, the transfer function A(s) has a gain of a constant value (finite value) rather than having an infinite value in a DC state (i.e., f=0). Hereinafter, the dimming feedback unit 150 according to an exemplary embodiment of the present invention will be described with reference to FIG. 3 and FIG. 4.

Figure 3:
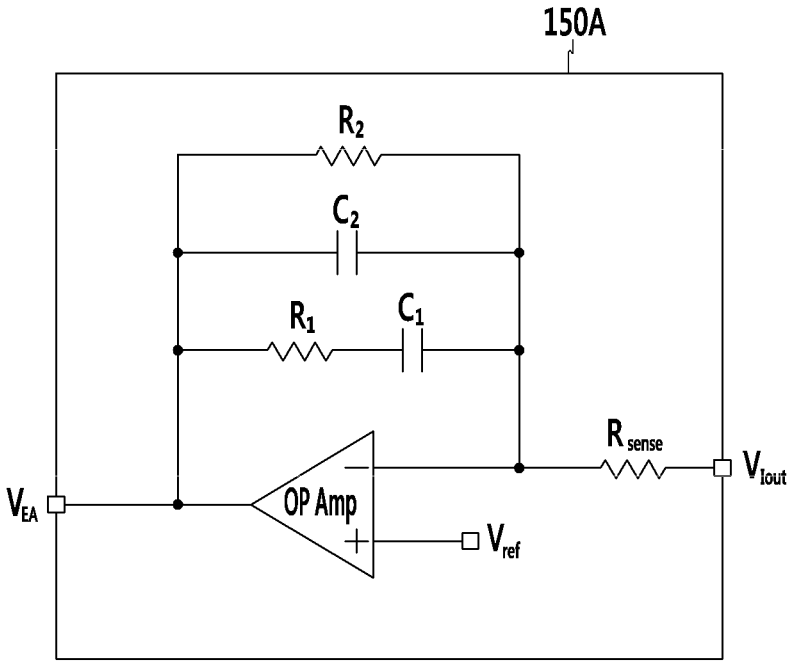
FIG. 3 shows a dimming feedback unit 150A according to the first exemplary embodiment of the present invention.

FIG. 3 shows a dimming feedback unit 150A according to the exemplary embodiment of the present invention.

As shown in FIG. 3, the dimming feedback unit 150A according to the exemplary embodiment includes an differential amplifier OP Amp, a resistor Rsense, a resistor R1, a capacitor C1, a capacitor C2, and a resistor R2.

A reference voltage $V_{ref}$ is input to a non-inverse terminal (+) of the differential amplifier OP Amp and a feedback voltage $V_{Iout}$ is input to an inverse terminal (−) of the differential amplifier OP Amp through the resistor Rsense. In addition, an error voltage $V_{EA}$ is output to an output terminal of the differential amplifier OP Amp.

The resistor R1 and the capacitor C1 are connected in series between the inverse terminal (−) and the output terminal of the differential amplifier OP Amp. In addition, the capacitor C1 and the resistor R2 are respectively connected between the inverse terminal (−) and the output terminal of the differential amplifier OP Amp.

Figure 4:
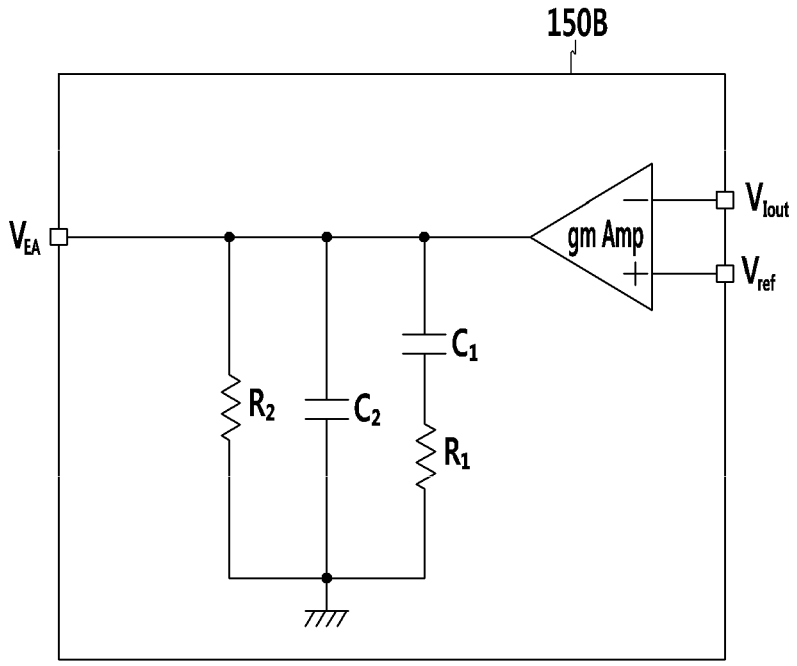
FIG. 4 shows a dimming feedback unit 150B according to the second exemplary embodiment of the present invention.

FIG. 4 shows a dimming feedback unit 150B according to another exemplary embodiment of the present invention.

As shown in FIG. 4, the dimming feedback unit 150B according to the other exemplary embodiment of the present invention includes a mutual conductance amplifier gm Amp, a resistor R1, a capacitor C1, a capacitor C2, and a resistor R2.

A reference voltage $V_{ref}$ is input to a non-inverse terminal (+) of the mutual conductance amplifier gm Amp and a feedback voltage $V_{Iout}$ is input to an inverse terminal (+) of the mutual conductance amplifier gm Amp. In addition, an error voltage $V_{EA}$ is output to an output terminal of the mutual conductance amplifier gm Amp.

In addition, unlike FIG. 3, in the present exemplary embodiment, the capacitor C1, the resistor R1, the capacitor C2, and the resistor R2 are connected in series between the output terminal of the mutual conductance amplifier gm Amp and a ground.

The dimming feedback units 150 according to the exemplary embodiments of FIG. 3 and FIG. 4 can be represented with a transfer function A(s) which is a ratio of the input feedback voltage $V_{out}$ and the output error voltage $V_{EA}$, and the transfer function A(s) can be represented as given in Equation 1.

$$A(s) = \frac{K\left(s - \frac{1}{R1C1}\right)}{\left(s - \frac{1}{R2C1}\right)\left(s - \frac{1}{R1C2}\right)} \quad \text{(Equation 1)}$$

In Equation 1, K is a constant (i.e., $$K = 20\log\left(\frac{R_2}{R_{sense}}\right)).$$

Figure 5:
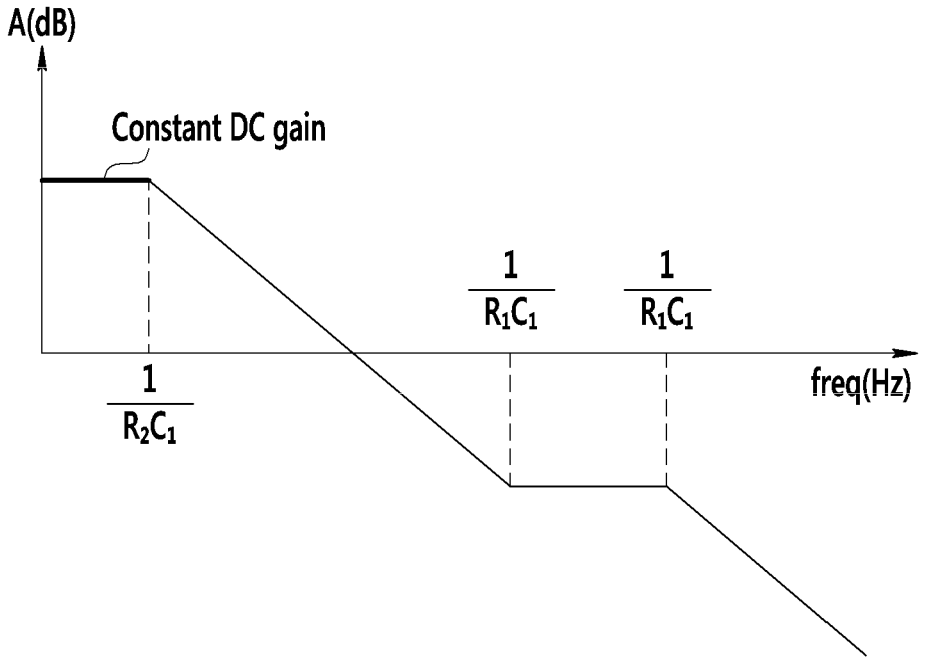
FIG. 5 shows a gain according a frequency of a transfer function A(s).

Equation 1, i.e., the transfer function A(s) can be drawn in a graph according to a frequency as shown in FIG. 5.

As shown in FIG. 5, the transfer function A(s) has an finite gain rather than an infinite gas in a DC state (i.e., f=0).

The dimming feedback unit 150 according to the exemplary embodiments of the present invention has a constant gain in a DC frequency by the resistors R2. That is, the dimming feedback units 150 have constant gains in DC frequency by the resistor R2 connected between the inverse terminal (+) and the output terminal of the differential amplifier OP Amp in FIG. 3 and the resistor R2 connected between the output terminal of the mutual conductance amplifier gm Amp and the ground in FIG. 4.

Hereinafter, a method for a power supply apparatus to perform a dimming operation according to an exemplary embodiment of the present invention will be described with reference to FIG. 6.

Figure 6:
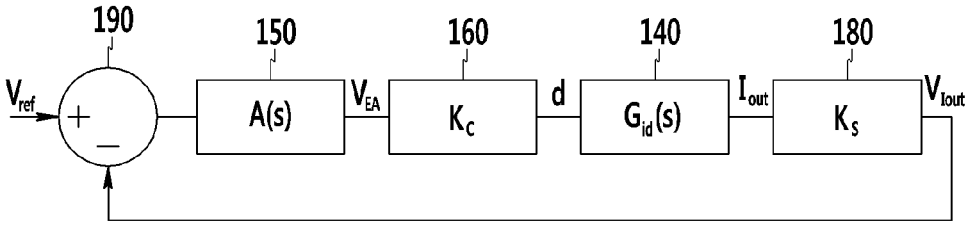
FIG. 6 shows each constituent element of the power supply apparatus according to the first exemplary embodiment of the present invention using a transfer function.
Figure 7A:
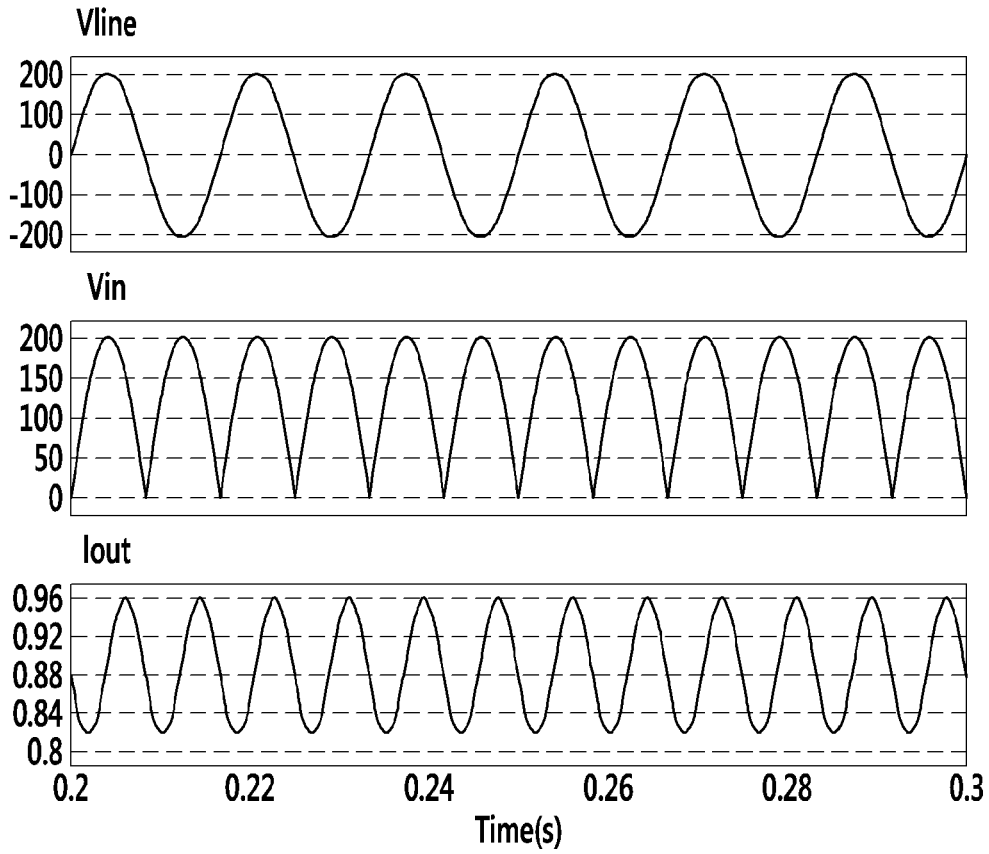
FIG. 7A to FIG. 7E show simulation results in case that dimming angles with respect to an output waveform of the traic dimmer 110 are respectively 180 degrees, 90 degrees, 45 degrees, 30 degrees, and 15 degrees.
Figure 7B:
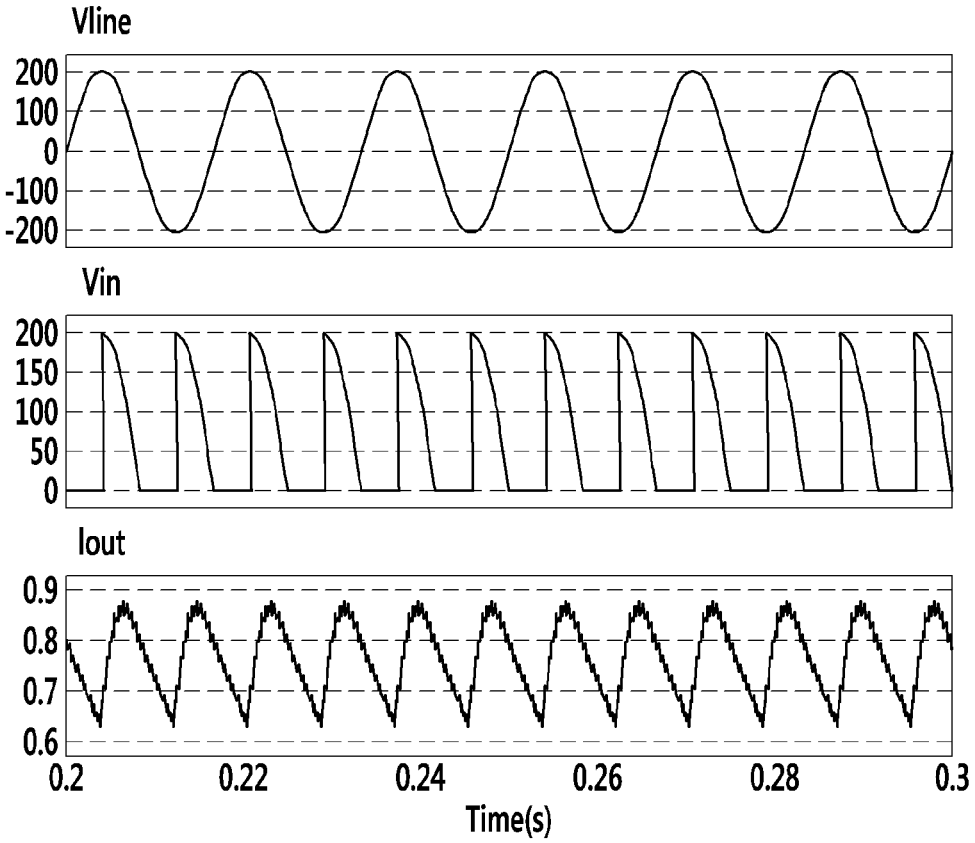
Figure 7C:
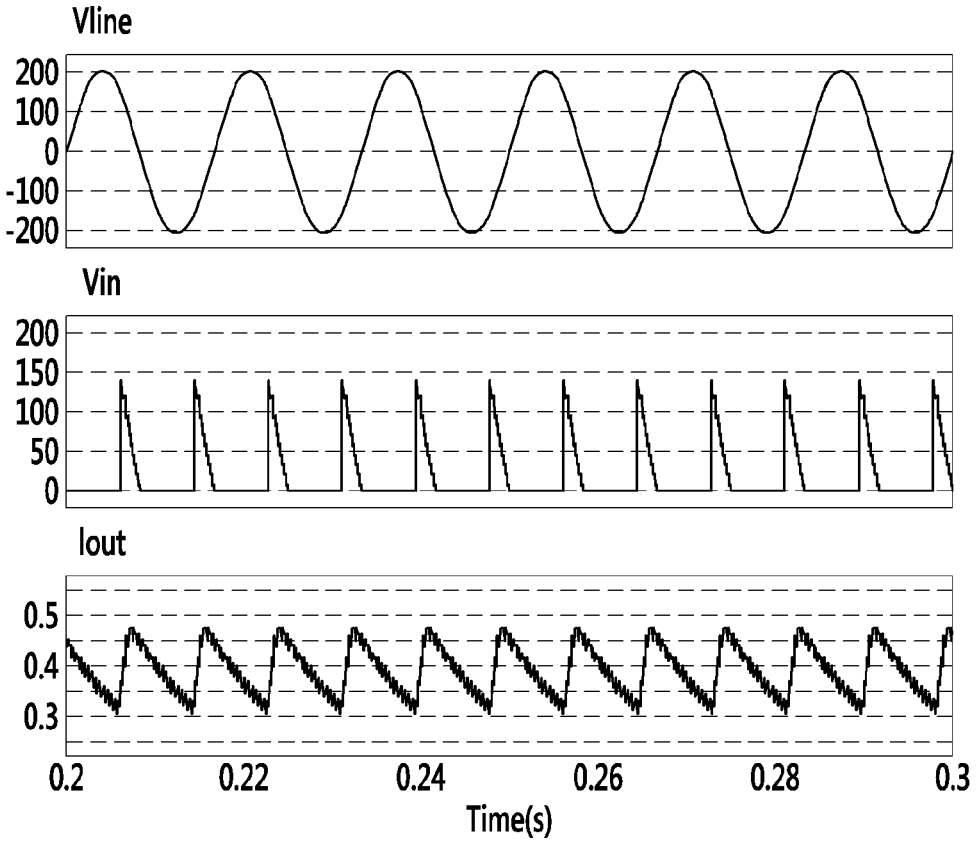
Figure 7D:
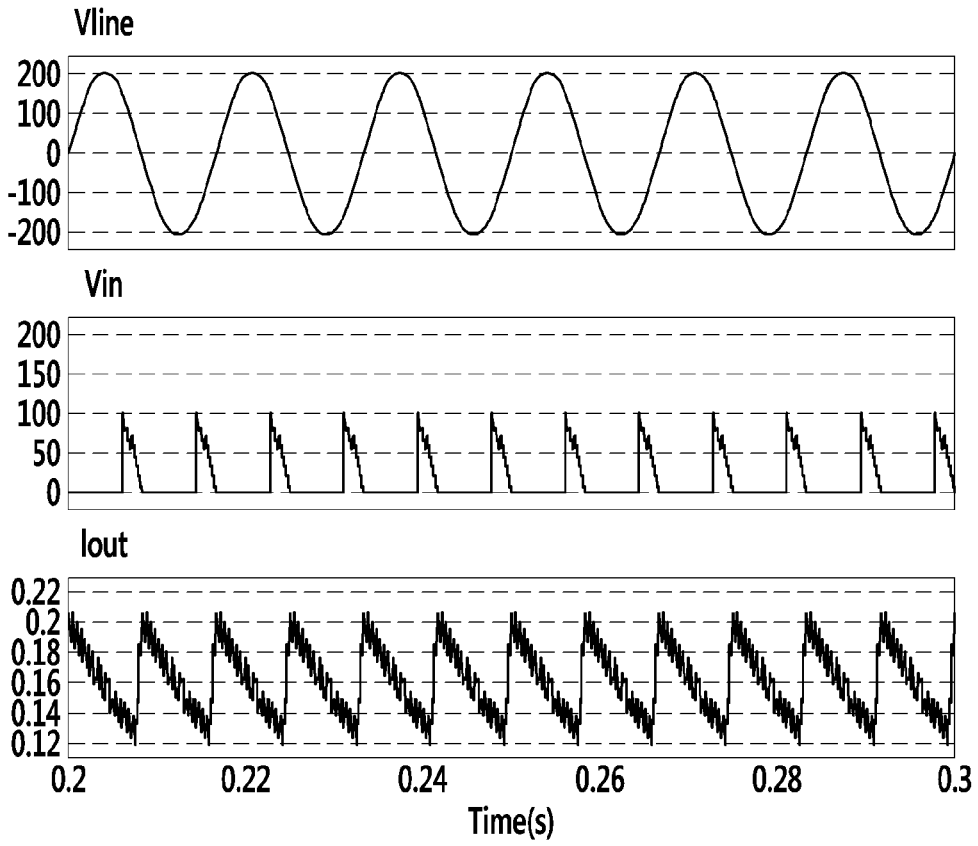
Figure 7E:
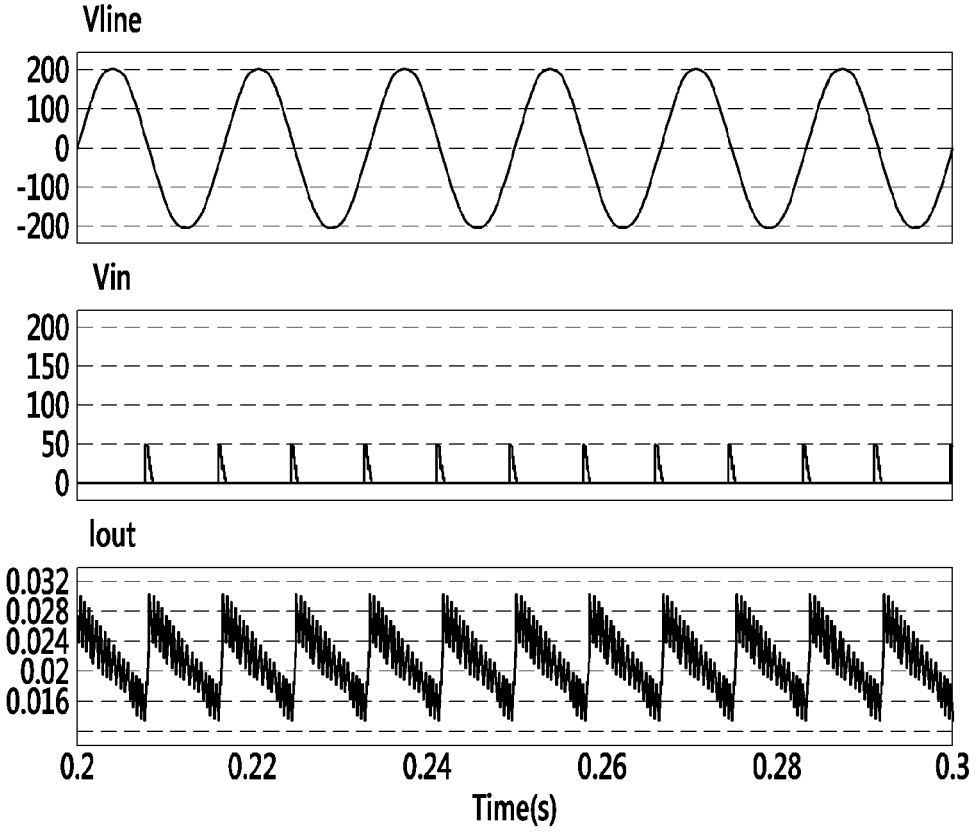

FIG. 6 schematically shows constituent elements of the power supply apparatus according to the present exemplary embodiment using a transfer function.

As shown in FIG. 6, a dimming feedback unit 150 can be represented as a transfer function A(s), a controller 160 as a constant $K_c$, and a converter 140 as a transfer function $G_{id}(s)$. In addition, a portion 180 that converts an output current $I_{out}$ to a feedback voltage $V_{Iout}$ may be represented by a constant $K_s$. Meanwhile, the feedback voltage $V_{Iout}$ and the reference voltage$_{ref}$ are respectively input to an inverse terminal and a non-inverse terminal of the dimming feedback 150, as shown in FIG. 3 and FIG. 4, and therefore the dimming feedback 150 may be represented as the reference numeral 190 of FIG. 9.

The transfer function $G_{id}(s)$ of the converter 140 is defined by a ratio of an output current $I_{out}$ and a duty d, and can be represented as given in Equation 2.

$$G_{id}(s) = \frac{I_{out}}{d} = \frac{G_{do}}{R_o}\frac{\left(1 - \frac{s}{\omega_z}\right)}{\left(1 + \frac{s}{Q\omega_o} + \left(\frac{s}{\omega_o}\right)^2\right)} \quad \text{(Equation 2)}$$

In Equation 2, $G_{do}$ has a value as given in Equation 3. In addition, $W_0$ is a unique natural frequency of the converter 140, $W_z$ denotes a zero frequency, and Q denotes a quality factor.

$$Gdo = \frac{\text{Vin, ave}}{(1-d)^2} \quad \text{(Equation 3)}$$

In Equation 3, $V_{in,ave}$ denotes an average value of a rectification voltage $V_{in}$ of the rectification unit 130. Therefore, the transfer function $G_{id}(s)$ van be simply represented by $V_{in,ave}$ and a function M(s) as shown in Equation 4.

$$G_{id}(s) = \frac{I_{out}}{d} = V_{in,ave} \cdot M(s) \quad \text{(Equation 4)}$$

Referring to Equation 2 and Equation 4, M(S) has a constant finite value in DC (f=0).

Meanwhile, the feedback voltage $V_{Iout}$ can be represented as given in Equation 5 by using a transfer function with respect to each constituent element of FIG. 6.

$$V_{Iout} = \frac{K_c * K_s * A(s) * G_{id}(s)}{1 + K_c * K_s * A(s) * G_{id}(s)} * V_{ref} = \frac{T(s)}{1 + T(s)} * V_{ref} \quad \text{(Equation 5)}$$

In Equation 5, T(s) (i.e., $K_c$*$K_s$*A(s)*$G_{id}$(s)) is a loop gain of FIG. 6, and $K_c$ and $K_s$ are constants. As shown in Equation 5, T(s)/(1+T(s)) functions as an error term in a relationship between $V_{Iout}$ and $V_{ref}$.

Meanwhile, when Equation 4 is used instead of $G_{id}$(s), T(s) can be represented as $V_{in,ave}$*$K_c$*$K_s$*A(s)*M(s). As previously described, A(s) and M(s) have finite values in DC (f=0), and therefore, T(s) has a value proportional to $V_{in,ave}$ in DC (f=0).

Since T(s) is proportional to $V_{in,ave}$ in DC (f=0), $V_{Iout}$ and $V_{ref}$ have the following relationship with reference to Equation 5.

First, as $V_{in,ave}$ (an average value of the rectification voltage) is increased, the error term (T(s)/(1+T(s))) of FIG. 5 becomes close to unity, and therefore $V_{Iout}$ becomes similar to $V_{ref}$. That is, a relationship of Equation 6 is established.

$$V_{Iout} \approx V_{ref} \quad \text{(Equation 6)}$$

Next, as $V_{in,ave}$ (the average value of the rectification voltage) is decreased, the error term (T(s)/(1+T(s))) of FIG. 5 becomes smaller than unity, and therefore $V_{Iout}$ becomes smaller than $V_{ref}$. That is, the following relationship of FIG. 7 is established.

$$V_{Iout} < V_{ref} \quad \text{(Equation 7)}$$

That is, referring to FIG. 6 and FIG. 7, when an average value $V_{in,ave}$ of the rectification voltage is decreased, the feedback voltage $V_{Iout}$ becomes a smaller value that is smaller than the reference voltage $V_{ref}$), and when the average value $V_{in,ave}$ of the rectification voltage is increased, the feedback voltage $V_{Iout}$ becomes similar to the reference voltage $V_{ref}$.

Meanwhile, in FIG. 1, the size of the dimming angle of the waveform output from the triac dimmer 110 is fluctuated according to user's control, and accordingly, the average value $V_{in,ave}$ of the rectification voltage is also fluctuated.

Therefore, when the dimming angle with respect to the output waveform of the triac dimmer 110 is decreased, the average value $V_{in,ave}$ of the rectification voltage is decreased, and by Equation 7, the feedback voltage $V_{Iout}$ becomes smaller than the reference voltage $V_{ref}$. The decrease of the feedback voltage $V_{Iout}$ implies a decrease of the output current $I_{out}$. That is, when the dimming angle with respect to the output waveform of the triac dimmer 110 is decreased, the output current $I_{out}$ flowing to the LED string 200 is decreased, and therefore brightness of the LED string 200 is darkened.

In addition, when the dimming angle with respect to the output waveform of the triac dimmer 110 is increased, the average value $V_{in,ave}$ of the rectification voltage is increased, and the feedback voltage $V_{Iout}$ becomes similar to the reference voltage $V_{ref}$ by Equation 6. The increase of the feedback voltage $V_{Iout}$ implies an increase of the output current $I_{out}$. That is, when the dimming angle with respect to the output waveform of the triac dimmer 110 is increased, the output current $I_{out}$ flowing to the LED string 200 is also increased, and therefore brightness of the LED string 200 becomes bright.

As described, in the present exemplary embodiment, the dimming operation can be performed without having an additional detection circuit that detects the size of a dimming angle with respect to an output waveform of the triac dimmer 110 and a configuration that fluctuates the reference voltage $V_{ref}$ according to the detection circuit. That is, the value of the transfer function A(s) of the dimming feedback unit 150 has a finite gain rather than having an infinite gain in DC (f=0) state, and therefore the dimming operation is automatically performed according to an output value of the triac dimmer 110.

FIG. 7A to FIG. 7E show simulation results when dimming angles with respect to the output waveform of the triac dimmer 110 are respectively 180 degrees, 90 degrees, 45 degrees, 30 degrees, and 15 degrees.

As shown in FIG. 7A to FIG. 7E, the output current $I_{out}$ is decreased as the dimming angle is decreased. That is, an average current of the output current $I_{out}$ is gradually decreased as the dimming angle is gradually decreased from 180 degrees to 15 degrees.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A power supply apparatus comprising:

a dimmer configured to control externally input power;

a converter including a switch, and configured to convert an output of the dimmer according to a duty of the switch and to supply a first current to a load;

a dimming feedback unit configured to receive a first voltage corresponding to the first current, and having a DC finite gain;

wherein the dimming feedback unit comprises:

an amplifier having the first voltage input to a first input terminal thereof and a predetermined reference voltage input to a second input terminal thereof, wherein the reference voltage does not fluctuate based on the output of the dimmer; and a controller configured to control the duty of the switch according to an output of the dimming feedback unit.

2. The power supply apparatus of claim 1, wherein when an angle of an output waveform of the dimmer is decreased, the first current is decreased, and when the angle of the output waveform of the dimmer is increased, the first current is increased.

3. The power supply apparatus of claim 1, wherein the dimming feedback unit comprises:

a first resistor coupled between the first input terminal and an output terminal of the amplifier.

4. The power supply apparatus of claim 3, wherein the dimming feedback unit further comprises a first capacitor coupled between the first input terminal and the output terminal of the amplifier.

5. The power supply apparatus of claim 4, wherein the dimming feedback unit further comprises a second resistor and a second capacitor coupled in series between the first input terminal and the output terminal of the amplifier.

6. The power supply apparatus of claim 5, wherein the amplifier is a differential amplifier, and the first voltage is input to the first input terminal through a third resistor.

7. The power supply apparatus of claim 3, wherein the desired reference voltage is a fixed value.

8. The power supply apparatus of claim 1, wherein the dimming feedback unit comprises:

an amplifier having the first voltage input to a first input terminal thereof and a desired reference voltage input to a second input terminal; and a first resistor coupled between an output terminal of the amplifier and a ground.

9. The power supply apparatus of claim 8, wherein the dimming feedback unit further comprises a first capacitor coupled between the output terminal of the amplifier and the ground.

10. The power supply apparatus of claim 9, wherein the dimming feedback unit further comprises a second capacitor and a second resistor coupled in series between the output terminal of the amplifier and the ground.

11. The power supply apparatus of claim 8, wherein the amplifier is a mutual conductance amplifier.

12. The power supply apparatus of claim 1, further comprising a rectification unit configured to rectify an output of the dimmer and to supply the rectified value to the converter.

13. The power supply apparatus of claim 1, wherein the load includes light-emitting diodes (LEDs).

14. The power supply apparatus of claim 1, wherein the first voltage is generated using the first current and the first voltage is supplied to the dimming feedback unit.

15. The power supply apparatus of claim 1, wherein the converter further comprises a transformer, and the power supply apparatus further comprises an output current estimation unit configured to generate the first voltage corresponding to the first current using primary side information of the transformer and to provide the first voltage to the dimming feedback unit.

16. A method for driving a power supply apparatus including a switch, converting externally input power through a duty of the switch and supplying a first current to a load, the method comprising:

controlling the input power;

rectifying the controlled power;

converting the rectified power through the duty of the switch and providing the first current to the load;

comparing the first voltage corresponding to the first current with a predetermined reference voltage and generating a second voltage, wherein the reference voltage does not fluctuate based on the controlled power; and controlling the duty of the switch corresponding to the second voltage, wherein a transfer function, which is a ratio of the first voltage and the second voltage, has a finite DC gain.

17. The method for driving the power supply apparatus of claim 16, wherein the first current is proportional to the controlled power.

18. The method for driving the power supply apparatus of claim 16, wherein the reference voltage has a fixed value.

19. The method for driving the power supply apparatus of claim 16, wherein the comparing comprises:

comparing the first voltage to the reference voltage using an amplifier and generating the second voltage with the amplifier, wherein a first input terminal of the amplifier is coupled to the first voltage and a second input terminal of the amplifier is coupled to the reference voltage, a first resistor is coupled between the first input terminal and an output terminal of the amplifier, and the second voltage is output to the output terminal of the amplifier.

20. The method for driving the power supply apparatus of claim 19, wherein a first capacitor is coupled between the first input terminal and the output terminal of the amplifier.

21. The method for driving the power supply apparatus of claim 20, wherein a second resistor and a second capacitor are coupled in series between the first input terminal and the output terminal of the amplifier.

22. The method for driving the power supply apparatus of claim 19, wherein the amplifier is a differential amplifier.

23. The method for driving the power supply apparatus of claim 16, wherein the load includes light-emitting diodes (LEDs).

* * * * *